US009239201B1

(12) United States Patent
Reis Green

(10) Patent No.: US 9,239,201 B1
(45) Date of Patent: Jan. 19, 2016

(54) FIREARM SUPPRESSOR

(71) Applicant: Austin Reis Green, Wales, WI (US)

(72) Inventor: Austin Reis Green, Wales, WI (US)

( * ) Notice: Subject to any disclaimer, the term of this patent is extended or adjusted under 35 U.S.C. 154(b) by 0 days.

(21) Appl. No.: 14/628,069

(22) Filed: Feb. 20, 2015

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS 6,575,074 B1 * 6/2003 Gaddini ..... 89/14.4
8,794,376 B2 * 8/2014 Shults et al. ..... 181/223
2011/0056111 A1 * 3/2011 Brittingham ..... 42/90
2014/0224575 A1 * 8/2014 Latka ..... 181/223
2014/0262605 A1 * 9/2014 Washburn et al. ..... 181/223
2014/0318887 A1 * 10/2014 Latka ..... 181/223

* cited by examiner

*Primary Examiner* — Jeremy Luks

(57) ABSTRACT

A firearm suppressor is provided. The suppressor includes a cylindrical body having first end and a second end opposite the first end. The cylindrical body includes an internal bore, the first end includes a receiving bore and the second end includes a discharge bore aligning with one another. The present invention further includes a plurality of baffles secured within the internal bore. Each of the baffles include a frusto-conical sidewall having an apex opposite a base. The apex includes an axial bore and is disposed towards the receiving bore. The base is disposed toward the discharge bore. The apex includes a semi-circular cut from the sidewall into the axial bore, forming a semi-circular protrusion. Further, a port is formed through the sidewall on an opposite side of the semi-circular cut and below the apex.

8 Claims, 2 Drawing Sheets

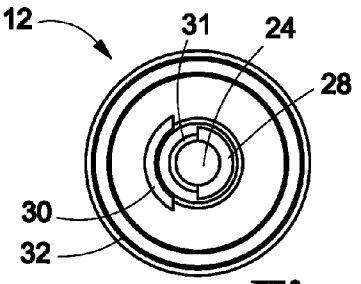
Fig. 4
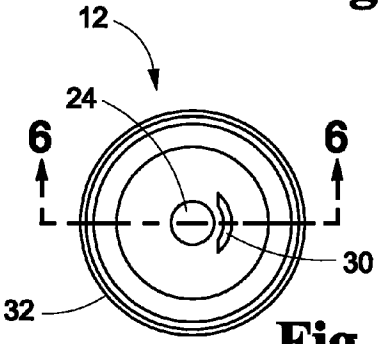
Fig. 5
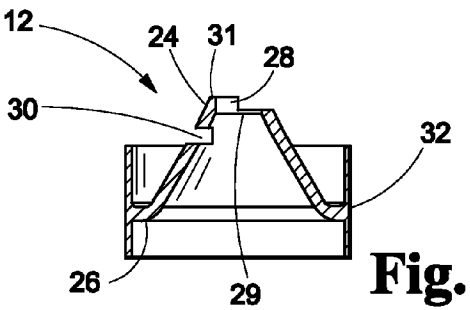
Fig. 6
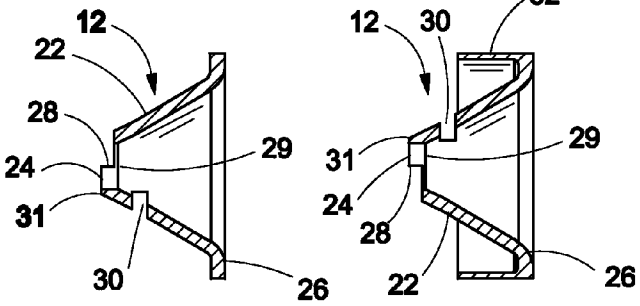
Fig. 3A
Fig. 3B
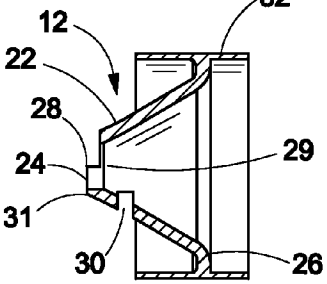
Fig. 3C
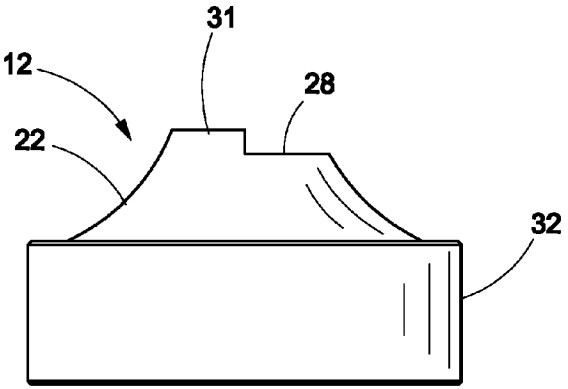
Fig. 7

FIREARM SUPPRESSOR

BACKGROUND OF THE INVENTION

The present invention relates to a firearm suppressor and, more particularly, to a firearm suppressor with a plurality of baffles having identical cuts and ports.

Firearm suppressors conventionally include a plurality of baffles contained within a cylindrical housing, or in some cases, the side walls of said baffles, when welded or threaded together, comprise the cylindrical housing which attaches to the distal end of the gun barrel. The baffles function to reduce the pressure, temperature, and velocity of propellant gases in order to suppress firearm muzzle blast. An industry-standard baffle is known as a conical baffle and has been in widespread use since approximately 1908. Another common version of the conical baffle is known as the "M" baffle, which simply combines the spacer (or side wall of the tube) and the conical baffle into one element. The "M" style of conical baffles date to 1910.

Conical baffles are popular because they have relatively high performance to weight and strength to weight ratios which lend them to today's center fire suppressor systems which compete in many specification categories such as size, weight, durability, and sound performance. Despite the popularity of conical baffles, a number of problems remain. High back-pressure, commonly associated with conical baffles, reduces host firearm operating reliability. Conical baffles isolate flow of high temperature gas and particulate matter to the aperture of the baffle where erosive wear is already a problem. Gas pressure is not smoothly regulated, so despite restricted gas flow, suppressors can create high intensity peak impulse noise unless carefully tuned with regard to spacing and other necessary features such as drilled holes, baffle orientations, expensive geometrical machining, casting, or stamping tooling and operations for the creation of turbulence, and calculated deletion of shear cuts in key areas. Resulting systems integrating frusto-conical baffles commonly involve several types of baffles and/or several lengths of spacer elements, and associated cost rises with system complexity. With this rise in complexity, manufacturing consistency and resultant quality of performance is also reduced. For companies and engineering teams, the development of product lines is difficult when each system requires intensive tuning and careful assembly for market-ability.

As can be seen, there is a need for a simpler and more effective suppressor.

SUMMARY OF THE INVENTION

In one aspect of the present invention, a firearm suppressor comprises: a cylindrical body comprising an internal bore and having a first end comprising a receiving bore and a second end comprising a discharge bore; a plurality of baffles within the internal bore, wherein each comprises: a frusto-conical sidewall comprising an apex opposite a base, wherein the apex comprises an axial bore and is disposed towards the receiving bore, and wherein the base is disposed toward the discharge bore, wherein the apex comprises a semi-circular cut from the sidewall into the axial bore, forming a semi-circular protrusion; wherein a port is formed through the sidewall on an opposite side of the semi-circular cut and below the apex.

These and other features, aspects and advantages of the present invention will become better understood with reference to the following drawings, description and claims.

BRIEF DESCRIPTION OF THE DRAWINGS

FIG. 3A is a cross-sectional view of a first embodiment of the baffle of the present invention;

FIG. 3B is a cross-sectional view of a second embodiment of the baffle of the present invention;

FIG. 3C is a cross-sectional view of a third embodiment of the baffle of the present invention;

FIG. 4 is a top view of the baffle of the present invention;

FIG. 5 is a bottom view of the baffle of the present invention;

FIG. 6 is a cross-sectional view along line 6-6 of FIG. 5; and

FIG. 7 is a perspective view of the third embodiment of the baffle of the present invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
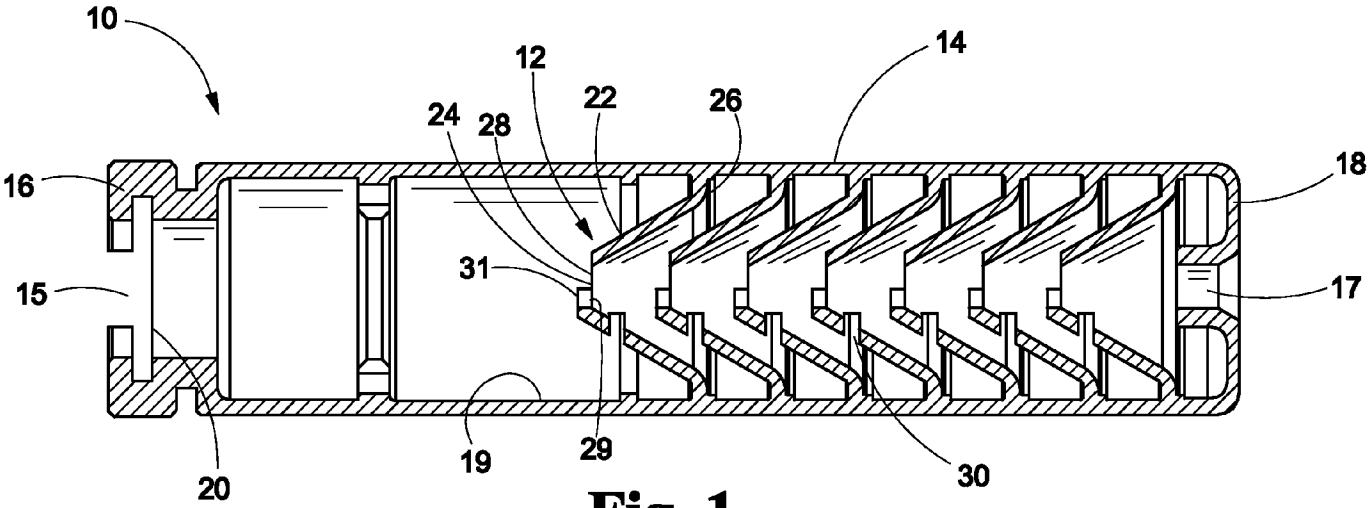
FIG. 1 is a cross-sectional view of a first embodiment of the present invention.
Figure 2:
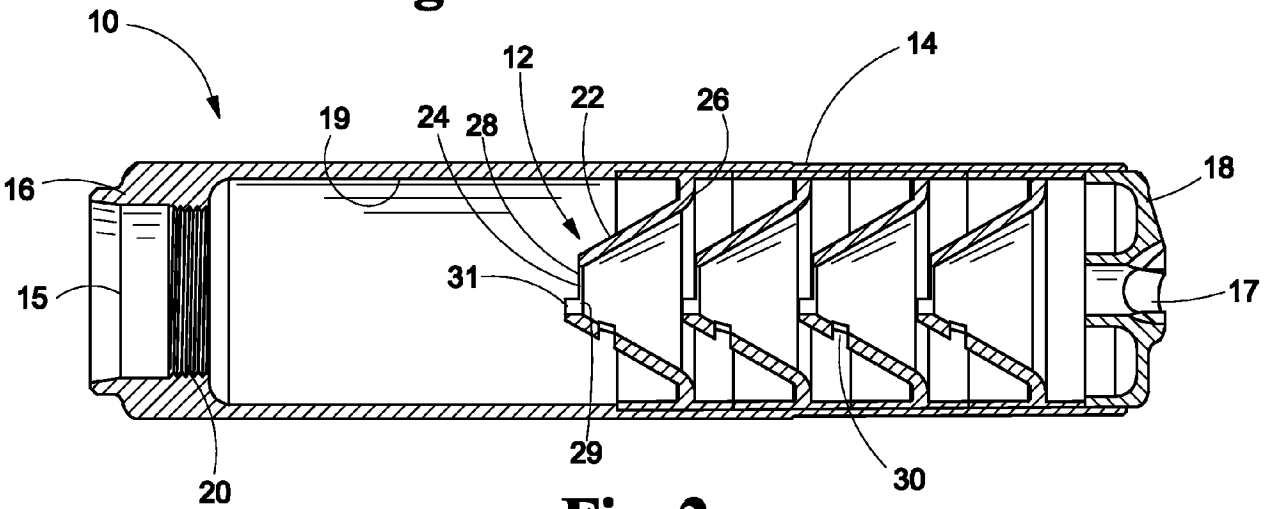
FIG. 2 is a cross-sectional view of a second embodiment of the present invention.

Referring to FIGS. 1 through 7, the present invention includes a firearm supressor 10. The suppressor 10 includes a cylindrical body 14 having first end 16 and a second end 18 opposite the first end 16. The cylindrical body 10 includes an internal bore 19, the first end 16 includes a receiving bore 15 and the second end includes a discharge bore 17. The bores 15, 17, 19 align with one another. The present invention further includes a plurality of baffles 12 secured within the internal bore 19. Each of the baffles 12 include a frusto-conical sidewall 22 having an apex 24 opposite a base 26. The apex 24 includes an axial bore 29 and is disposed towards the receiving bore 15. The base 26 is disposed toward the discharge bore 17. The apex includes a semi-circular cut 28 from the sidewall into the axial bore 29, forming a semi-circular protrusion 31. Further, a port 30 is formed through the sidewall 22 on an opposite side of the semi-circular cut 28 and below the apex 24. The suppressor 10 may be attached to a firearm via a connector 15 in the receiving bore 15, such as a threaded connector or other connector 15 designed to interface with the receiving bore 15.

Each baffle 12 can be provided with an axial bore 29 large enough to accommodate the passage of the projectile fired from the weapon. Each axial bore 29 in each baffle 29 can be in coaxial alignment so that a projectile fired from a weapon can pass unobstructed through the receiving bore 15, the internal bore 19, the axial bores 29 of the plurality of baffles 12, until exiting the discharge bore 17 formed in the second end 18. The plurality of baffles 12 may be integral with the cylindrical body 10 or formed separately and inserted into the cylindrical body 10.

As illustrated in FIGS. 2, 3B, 3C and 7, each baffle 12 may include an annular spacer 32. The annular spacer 32 may be attached to the base 26 and may be substantially perpendicular to the base 26. The baffles 12 are stacked, or welded together and inserted within the cylindrical body 14 so that the annular spacers 32 are joined or resting against one another. The baffles 12 can be formed by casting or stamping, and are manufactured so as to insure a precise fit between the outer circumference of the annular spacer 32 and the inner circumference of the internal bore 19. By closely fitting the annular spacer 32 to the internal bore 19, expanding gasses, combustion by-products and sound energy can be prevented from passing between the annular spacer 32 and the internal bore 19 thereby increasing the efficiency with which the suppressor 10 can suppress noise and muzzle flash. Further, the baffles 12 may be spaced apart by the spacers 32.

The port 30 of the present invention is an opening that may be located just below the apex 24 and may be enclosed by sidewall 22. The port 30 may be positioned so that a central portion of the port 30 is approximately 180 degrees from a central portion of the semi circular cut 28. Therefore, the port 30 may be located just beneath the protrusion 31. In certain embodiments, the apex 24 of the present invention may include a portion having an unvarying diameter prior to the diameter increasing gradually to the base 26. The semi-circular cut 28 may be cut into the portion of the unvarying diameter so that the axial bore 29 formed between the cut 28 and the protrusion 31 may be a circle.

As mentioned above, the present invention includes a plurality of baffles 12 with the same cut 28 and port 30. For example, the plurality of baffles 12 may include three or more baffles 12 when similar baffles with cut 28 and port 30 are used exclusively in the suppressor system without inclusion of other type baffles. In certain embodiments, the present invention may include four, five, six, seven, or more baffles 12 with the same cut 28 and port 30. In certain embodiments, when four or more baffles 12 with the cut 28 and port 30 are used in a suppressor system, the exclusive use of the baffles 12 may be used when optimal sound performance is desired.

In certain embodiments, the semi-circular cut 28 may be a shear cut. The shear cut creates cross-axial flow of gas in relation to the internal bore 19, forcing gas to expand and travel through the suppressor 10 prior to exiting, increasing sound performance of the suppressor baffles 12. In operation, high velocity gas streams are directed through both the cut 28 and port 30 simultaneously, colliding and creating rough, turbulent flow which reduces the velocity and energy of the pressure streams, while simultaneously enhancing and regulating flow through the system. The net result is a superior suppressor system with smooth, regulated flow, reduced back pressure, enhanced host firearm reliability, and reduced peak impulse sound at both the firearm ejection port and suppressor muzzle.

Example

The present invention was tested against several styles of baffles in 308 caliber, utilizing a standard blast chamber length, bore diameter, and baffle system length. For testing purposes, a calibrated B&K 2209 meter was set to A weighting and Peak Hold, with ¼" microphone. Suppressor systems were tested at 1 meter left of the muzzle using MIL-STD 1474-D industry protocols. Tested prior art suppressors included domed peripherally ported, baffles with and without shear cuts, [conical] baffles with distal (base end) round ports on the periphery, baffles with shear cuts and fluted sidewall geometry for the generation of turbulence, and one of the Maxim 1909 baffles. The 1909 baffle is similar to one currently used by Finland's ASE Utra in their "S" series suppressors. It was found that even moderate suppressor performance was difficult to attain with these prior art systems. The thirteen domed ported baffle suppressor had a peak impulse noise metered at 154.2 DB. The suppressor with nine symmetrical cones without ports had a peak impulse noise metered at 151.2 DB. The suppressor with nine symmetrical cones with ports had a peak impulse noise metered at 150.6 DB. The Maxim 1909/ASE S series style baffles had a peak impulse noise metered at 145.2 DB. The suppressor with nine shear cut baffles had a peak impulse noise metered 144.8 DB. The suppressor with eleven shear cut baffles had a peak impulse noise metered at 143.6 DB. The suppressor with nine shear cut cones with fluted turbulence generating geometry had a peak impulse noise metered at 143 DB.

The present invention was tested using baffles with the cut and the port exclusively in several different random configurations using the same suppressor system size, blast chamber length (except as noted), and bore diameter. In a nine baffle configuration, the present invention had a peak impulse noise metered at 137.2 DB. In a six baffle configuration, the system had a peak impulse noise metered at 137.6 DB. In a five baffle configuration, the system had a peak impulse noise metered at 138.8 DB. Using the spacing of the six baffle configuration and a spacer to remove the most proximal baffle for a five baffle system (altering the control blast chamber size), the suppressor had a peak impulse noise metered at 138.5 DB. Dropping to a four baffle configuration using the five baffle spacing configuration by replacing the most proximal baffle with a spacer had a peak impulse noise metered at 140.1 DB.

The prior art suppressors averaged peak impulse noise at 147.51 DB, compared with the present invention which averaged peak impulse noise at 138.44 DB. The present invention on average includes an advantage of 9.07 DB over the prior art. Therefore, the suppressor of the present invention includes a superior performance as compared to the prior art. When used in sequence, the baffle of the present invention is clearly superior to other types of baffles. Without tuning, with lighter system weight and reduced developmental complexity, the present invention achieved performance that bettered all other tested systems by a broad margin. When used in sequence, the baffle requires little to no tuning for market leading performance.

It should be understood, of course, that the foregoing relates to exemplary embodiments of the invention and that modifications may be made without departing from the spirit and scope of the invention as set forth in the following claims.

What is claimed is:

1. A firearm suppressor comprising:

a cylindrical body having a first end and a second end, wherein the first end comprises a receiving bore, the second end comprises a discharge bore and the cylindrical body comprises an internal bore; and at least four baffles within the internal bore, wherein each baffle comprises:

a frusto-conical sidewall comprising an apex having an axial bore and a base opposite the apex, wherein the apex is disposed towards the receiving bore and the base is disposed toward the discharge bore, wherein the apex comprises a semi-circular cut from the sidewall into the axial bore, forming a semi-circular notch;

wherein a port is formed through the sidewall in between the apex and the base, wherein the port is on a radially opposing side of the sidewall from the semi-circular cut.

2. The firearm suppressor of claim 1, wherein the port is rectangular shaped.

3. The firearm suppressor of claim 1, wherein a central portion of the port is 180 degrees from a central portion of the semi-circular cut.

4. The firearm suppressor of claim 1, wherein the apex comprises a portion comprising an unvarying inner diameter, wherein the semi circular cut is cut into the portion so that the axial bore is a circle.

5. The firearm suppressor of claim 1, wherein the plurality of baffles are integral with the cylindrical body.

6. The firearm suppressor of claim 1, wherein each of the plurality of baffles comprises an annular spacer attached to and surrounding the base.

7. The firearm suppressor of claim 6, wherein the baffles are stacked within the cylindrical body so that the annular spacers are resting against one another.

8. The firearm suppressor of claim 1, wherein each of the ports of the baffles are identical to one another and each of the semi-circular cuts of the baffles are identical to one another.

* * * * *